US006868568B2

(12) United States Patent
Souther

(10) Patent No.: US 6,868,568 B2
(45) Date of Patent: Mar. 22, 2005

(54) ADJUSTABLE HEAD REST

(76) Inventor: Hamilton Souther, 1306 Karina Way, Santa Clara, CA (US) 95050

( * ) Notice: Subject to any disclaimer, the term of this patent is extended or adjusted under 35 U.S.C. 154(b) by 21 days.

(21) Appl. No.: 10/062,900

(22) Filed: Jan. 31, 2002

(65) Prior Publication Data

US 2003/0140421 A1 Jul. 31, 2003

(51) Int. Cl.[7] ..... A47C 20/02
(52) U.S. Cl. ..... 5/640; 5/630; 5/636; 5/656
(58) Field of Search ..... 5/630, 636, 640, 5/656, 657

(56) References Cited

U.S. PATENT DOCUMENTS 833,987 A * 10/1906 Truslow ..... 5/640
1,431,110 A * 10/1922 Fromhart ..... 5/636
2,197,343 A * 4/1940 Marx ..... 5/640
2,962,820 A * 12/1960 Petersen ..... 434/278
3,572,835 A * 3/1971 Kees et al. ..... 297/410
3,806,110 A * 4/1974 Glasser et al. ..... 5/640
5,467,490 A * 11/1995 Rice ..... 5/636
5,940,913 A * 8/1999 Horowitz ..... 5/640
6,159,169 A * 12/2000 Lambden ..... 601/15
6,182,313 B1 * 2/2001 Eschenbach ..... 5/640
6,264,522 B1 * 7/2001 Dickson ..... 446/120

OTHER PUBLICATIONS http://www.indigo.com: Indigo Instruments, Molecular Model, 1998.*

* cited by examiner

*Primary Examiner*—Teri Pham Luu

(57) ABSTRACT

A head rest device is described. A plurality of spherical components are coupled via a plurality of adjustable connecting members. At least one end of each of the plurality of connecting members are coupled to a spherical component of the plurality of spherical components.

26 Claims, 6 Drawing Sheets

ADJUSTABLE HEAD REST

FIELD OF THE INVENTION

This invention relates to head rests, and more particularly to adjustable head rests.

BACKGROUND

Today pace of living introduces a lot of stress into human lives. Stress affects one's performance at work, interaction with co-workers and family members. In some situation stress may turn into depression that may cause a person to loose interest and pleasure in daily activities and impair functioning of one's daily life.

Relaxation is a key to an effective stress relief. One of techniques that may be utilized to relief stress is acupuncture. Acupuncture can be described as an insertion of very fine needles into the skin at specific acupuncture points in order to influence the functioning of the body. One of the popular alternatives to acupuncture is acupressure. Acupressure is a non-invasive method of massage therapy constituting pressing of acupuncture points, i.e. acupoints, on human body. Stimulation of the acupuncture points is performed by a practioner using his/her fingers or an instrument with a hard ball shaped head.

The human body comprises 365 acupoints. Some acupoints are located at the back of the human head and are known in acupuncture as the "heavenly gate". Four points constituting the "heavenly gate" are located at the base of the skull, underneath the occipital ridge, as illustrated in FIG. 7. When pressure is applied to these acupoints, a deep state of relaxation may be reached within minutes. The location of these points does not allow a person to effectively self-apply pressure to the heavenly gate's acupoints. Thus, help of another individual is necessary. However, one may be faced with situations where it is impractical, if not impossible, to find another individual who will be able and willing to apply pressure to the heavenly gate acupoints in order to reach a deep state of relaxation.

SUMMARY OF THE INVENTION

A head rest device is described. The adjustable head rest comprises a plurality of spherical components coupled via a plurality of adjustable connecting members. At least one end of each of the plurality of connecting members is coupled to a spherical component of the plurality of spherical components.

Additional features and advantages of the present invention will be apparent from accompanying drawings and from the detailed description that follows.

BRIEF DESCRIPTION OF THE DRAWINGS

The features and advantages of the invention will be understood by reading the following description in conjunction with the drawings, where.

DETAILED DESCRIPTION

In the following description, numerous specific details are set forth in order to provide a thorough understanding of the present invention. It will be apparent, however, to one skilled in the art that these specific details need not be employed to practice the present invention. In other instances, well known materials or methods have not been described in detail in order to avoid unnecessarily obscuring the present invention.

It will be appreciated that the terms "coupled", "coupled to" and "coupled with", as used herein, mean connected directly or connected through one or more intervening components. It will be appreciated that the term "spherical components", as used herein, means any geometrical figure with a top rounded surface, for example, a sphere, a half a sphere, etc. It will also be appreciated that the term "connecting member", as used herein, means a connecting arrangement comprising one or several components. In addition, it will be appreciated that the term "pivotally coupled", as used herein, means hinged, coupled via a ball and socket joint, coupled via a screw or coupled via a pin.

A head rest device is described. More specifically, an adjustable head rest device activating acupressure points is described. Note that in this description, references to "one embodiment" or "an embodiment" mean that the feature being referred to is included in at least one embodiment of the present invention. Further, separate references to "one embodiment" in this description do not necessarily refer to the same embodiment; however, neither are such embodiments mutually exclusive, unless so stated and except as will be readily apparent to those skilled in the art. Thus, the present invention can include any variety of combinations and/or integrations of the embodiments described herein.

Figure 1:
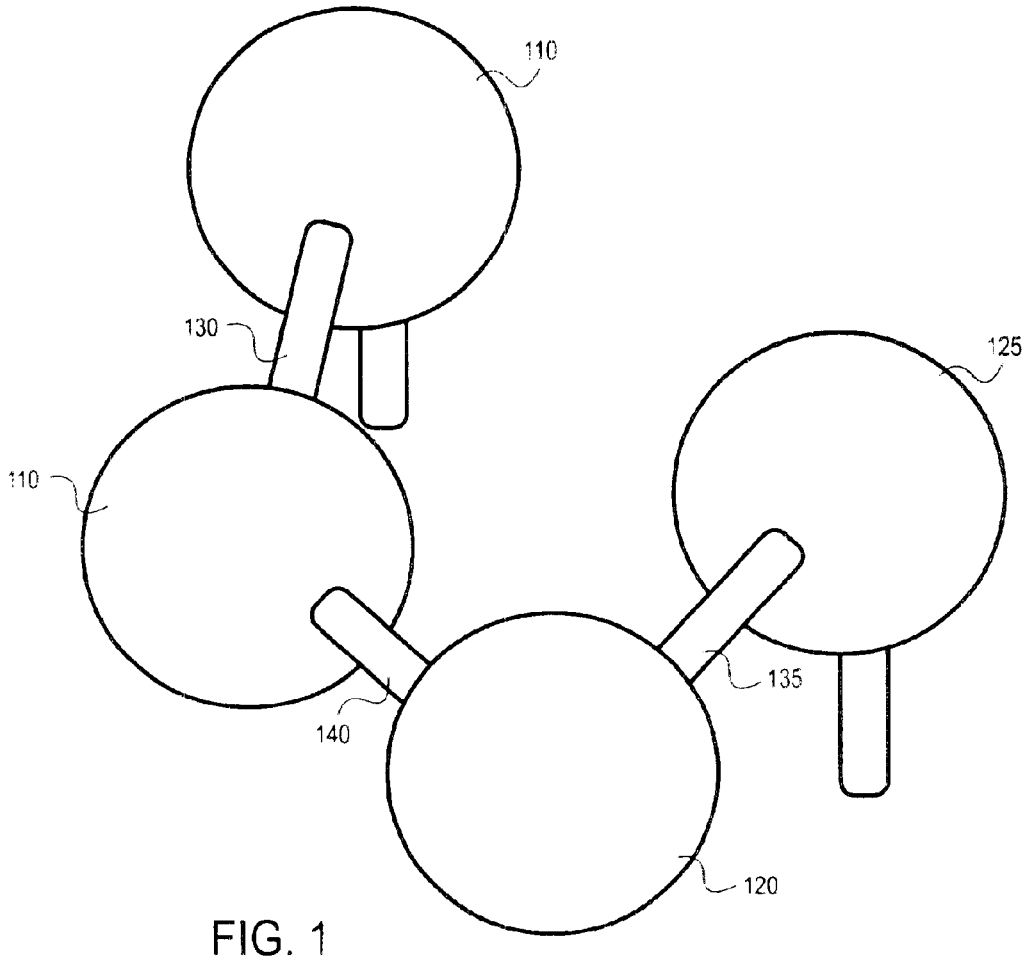
FIG. 1 is a perspective view of a head rest according to one embodiment of the present invention.

FIG. 1 illustrates a plain view of the head rest device 100 according to one embodiment of the present invention. The head rest device 100 comprises four spherical components 110, 115, 120 and 125 connected to each other via connecting members 130 and 135 that allow adjustment of the distance between the spherical components. The connecting members may allow the adjustment of an angular position of spherical components in relation to each other, as described in detail below. The spherical components 110, 115, 120 and 125 may be made of rubber, styro foam, plastic, wood, etc. In one embodiment the spherical components are hollow. In another embodiment the spherical components are solid. In a case of a spherical components made out of a harder material, such as wood, the outer surface of the spherical components may be covered in softer material such as rubber, or foam like material to provide soft surfaces that come into contact with a human head to provide comfort. It will be appreciated that the spherical components are not limited to the materials mentioned above and may be made out of any material, or combination of materials to provide soft spherical surfaces that come into contact with a human head to ensure comfort.

In one embodiment, the spherical components 110, 115, 120 and 125 are ball like structures, i.e., spheres. In another embodiment of the invention, the spherical components are half of spheres. Yet, in another embodiment of the head rest device, the spherical components are any geometrical figure with a rounded top surface that may come in contact with a human head.

Figure 2:
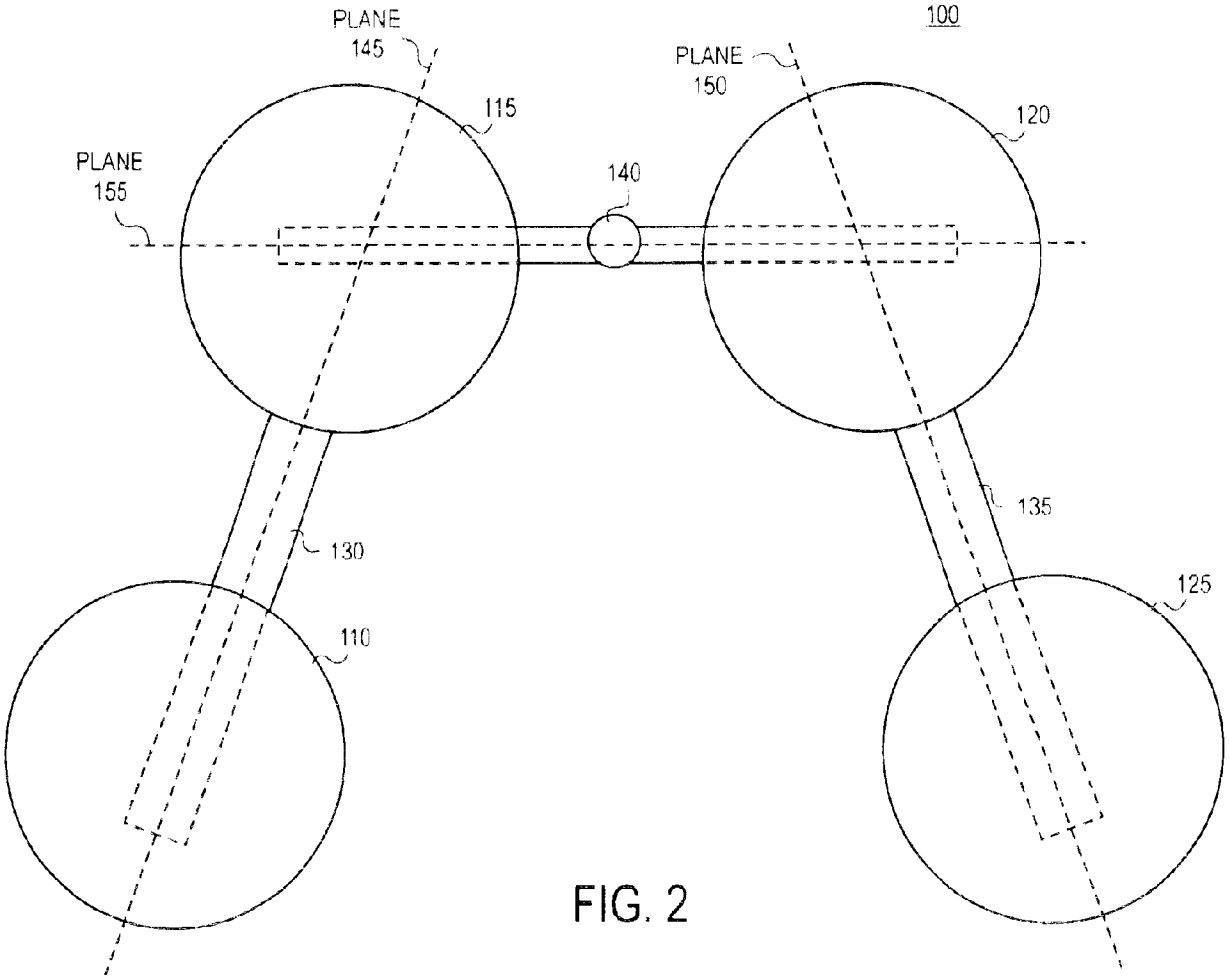
FIG. 2 is a perspective top view of the head rest according to one embodiment of the present invention.
Figure 5:
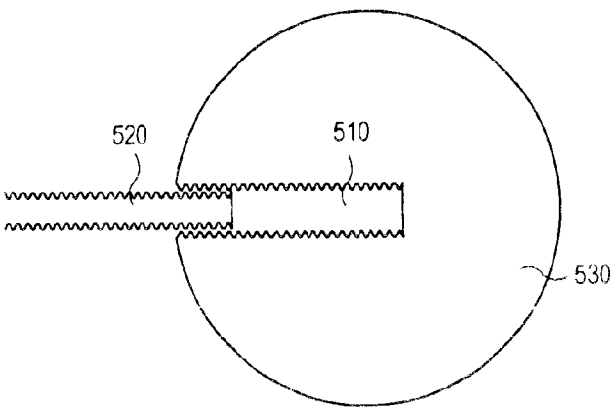
FIG. 5 illustrates a connecting member according to one embodiment of the present invention.

FIG. 2 illustrates a top view of the head rest device according to one embodiment of the present invention. Spherical components 115 and 120 are coupled to the connecting member 110 and 125, respectively. In one embodiment one end of the connecting member 130 is firmly attached to the spherical component 115. One end of the connecting member 135 may also be firmly attached to the spherical component 120. In one embodiment the opposite end of the connecting members 130 and 135 may be threaded and threadably coupled to the spherical components 110 and 125, respectively. FIG. 5 illustrates such a connection. In this embodiment the spherical components 130 and 135, illustrated by a spherical component 530, have a threaded opening 510 in order to ensure proper connection with the threaded end 520 of the connecting members 130 and 135 provided by screwing the connecting members 130 and 135 into the spherical components 110 and 125, respectively. The threaded connection allows adjustment of the distance between the spherical components 110 and 115 and distance between the spherical components 125 and 120 to fit the size of the head of a user of the head rest device in such a way as to allow the top surfaces of the spherical components to come into contact with the "heavenly gate" acupoints.

In an alternative embodiment of the present invention, the connecting members 130 and 135 of FIG. 2 are rigidly attached to the spherical components 110, 115, 120 and 125 at both ends. In this embodiment the connecting members 130 and 135 comprise three components illustrated in FIGS. 4A and 4B. The connecting members 130 and 135, illustrated as 430, comprise two hollow rods 410 and 415. Rod 410 is of a smaller diameter than rod 415 in order to allow rod 410 to slide in and out the rod 415 and provide the user of the head rest device with an ability to adjust the distance between the spherical components 110 and 115 and the spherical components of 125 and 120 illustrated in FIG. 2.

Figure 4C:
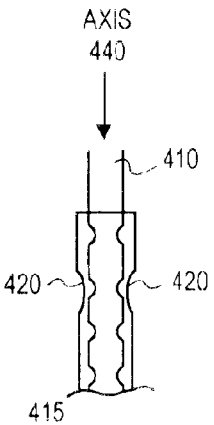
FIG. 4C illustrates a portion of a connecting member according to one embodiment of the present invention.
Figure 4B:
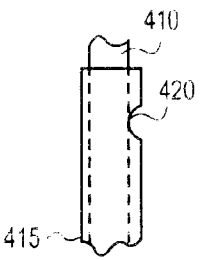
FIG. 4B illustrates a portion of a connecting member according to one embodiment of the present invention.

In one embodiment in order to secure the user-selected relative position of the rods 415 and 410, the rod 415 has an opening 420 illustrated in FIG. 4B. The thickness of the solid part of the rod 415 defining the opening 420 may be threaded in order to allow a threaded pin 435 to be screwed into the opening 420 to come in contact with the outer surface of the rod 410 to hold it in stationary position by pushing the outer surface of the rod 410 against the inner surface of the rod 415. It will be appreciated that the present invention is not limited to the usage of the threaded pin and any similar device may be used to hold the two rods in a stationary position. In addition, the solid portion of the rod 415 defining the opening 420 is not limited to being threaded and may be smooth depending on the device used to secure the two rods in a user-selected position. For example, as illustrated in FIG. 4C, rod 410 may have a plurality of openings spaced at a particular interval through the outside surfaces of the rod along an axis perpendicular to the vertical axis 440 of the rod 410 in order to allow a pin or a screw to be inserted through the openings and penetrate the rod 410. In addition, the rod 415 may have an opening 420' opposite to the 420 in order to allow a pin or a screw to be inserted to penetrate the rod 415, the pin or a screw will be inserted perpendicular to the vertical axis 440 of the rod 415. Upon alignment of the openings 420' and 420 with two openings from the plurality of openings located on the opposite sides of the rod 410, a pin or a screw may be inserted to hold the two rods secure in a user-selected position.

Figure 6:
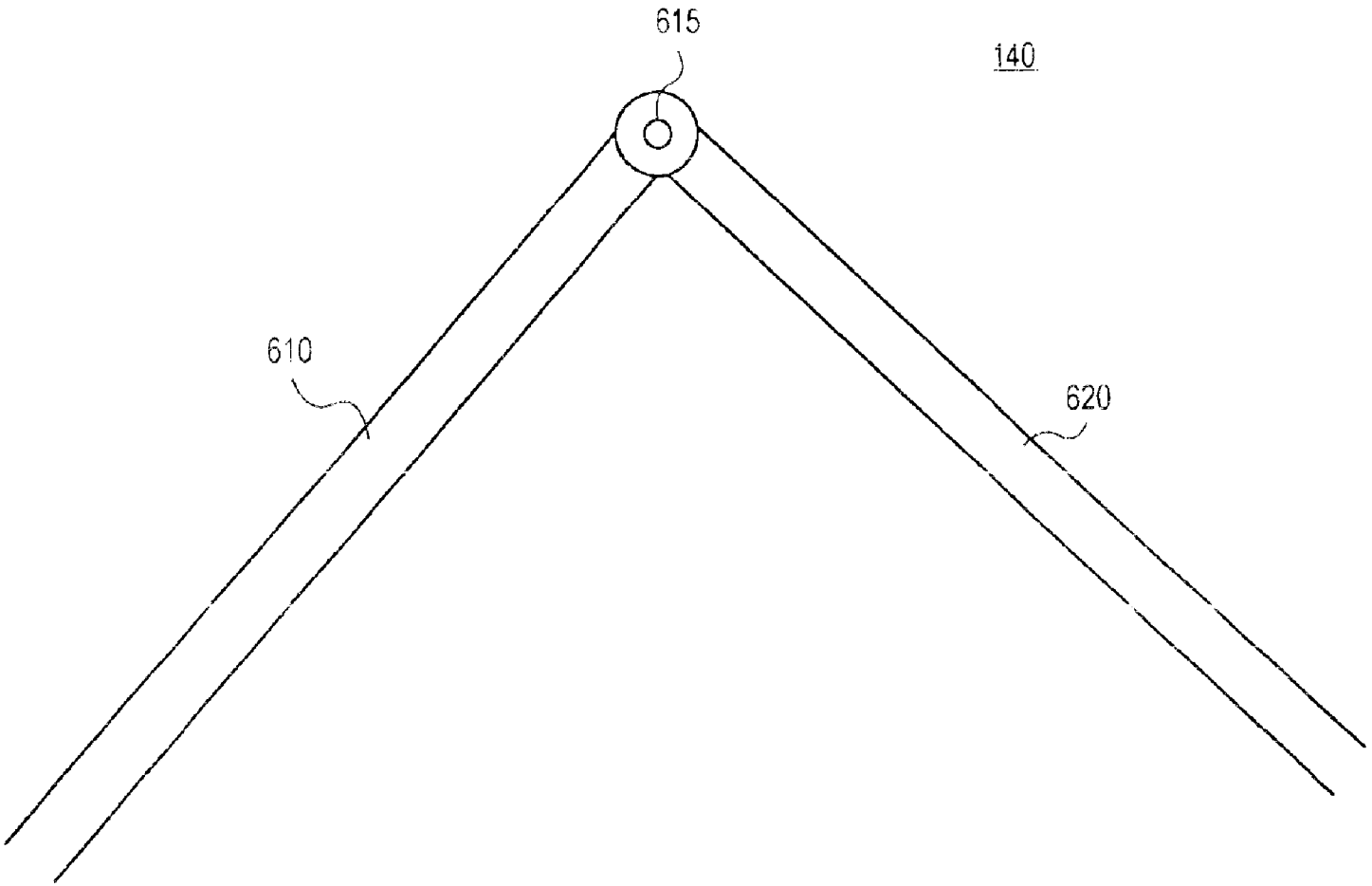
FIG. 6 illustrates a connecting member according to one embodiment of the present invention.
Figure 7:
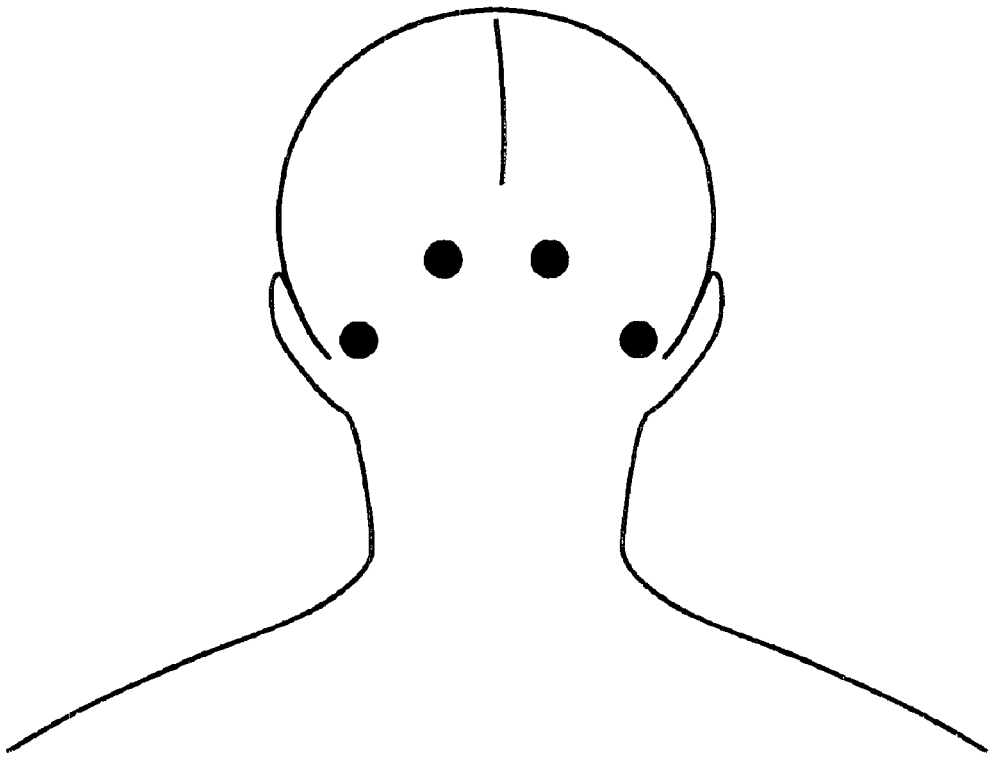
FIG. 7 illustrates heavenly gate's acupoints to which pressure may be applied utilizing one embodiment of the present invention.

FIG. 6 illustrates the connecting member 140 of FIG. 2 that is utilized to connect the spherical components 115 and 120 according to one embodiment of the present invention. In one embodiment the connecting member 140 comprises rods 610 and 620 pivotally connected. At one end the rods 610 and 620 may be threadably coupled to the spherical components 115 and 120, respectively, as described above with reference to FIG. 5, in order to allow adjustment of the distance between the spherical components 115 and 120. At an end opposite to the one attached to a spherical component, the rods 610 and 620 may contain an opening. Upon alignment of the openings of the rods 610 and 620, the rods 610 and 620 may be pivotally coupled to each other via a pin inserted through the aligned openings to allow an angular adjustment of the rods relative to each other. In one embodiment, the rods 610 and 620 may be pivotally coupled to each other via a screw. It will be appreciated that there are other well known techniques in the art to pivotally couple rods 610 and 620 and the present invention is not limited to the coupling mechanism described above.

Figure 4A:
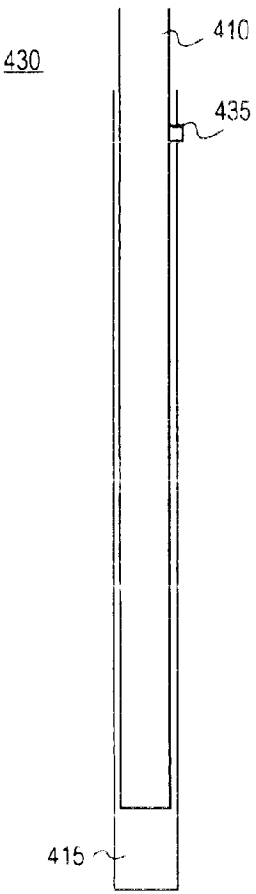
FIG. 4A illustrates a connecting member according to one embodiment of the present invention.

In one embodiment the rods 610 and 620 may be rigidly attached at one end to the spherical components 115 and 120 and comprise two components of different diameters, as described with reference to FIG. 4A and FIG. 4B.

In one embodiment of the present invention the rods 610 and 620 may be of a smaller diameter or thickness at the end containing the opening than at the end that is being attached to the spherical components. The difference in diameter or thickness at the end containing the opening may ensure that the thickness of the two rods when aligned on top of each other, according to one embodiment of the present invention, does not alter the relative height of the spherical components 115 and 120.

By adjusting the angle between the rod like components 610 and 620, the distance between the spherical components 115 and 120 may be changed. In addition, the adjustment of the angle between the rod like components 610 and 620 may allow the adjustment of an angle between a vertical plane 150 of FIG. 2 comprising spherical components 120 and 125 and a vertical place plane 155 of FIG. 2 comprising spherical components 115 and 120. The adjustment of the angle between the rod like components 610 and 620 may allow the adjustment of an angle between a vertical plane 145 comprising spherical components 110 and 115 and the vertical plane 155 comprising spherical components 115 and 120.

In one embodiment of the present invention, the connecting member 130, 135, 140 are made out of metal, such as copper, aluminum, wood, plastic or any composite material. It will be appreciated that the present invention is not limited to the connecting member comprising the above mentioned materials.

Figure 3:
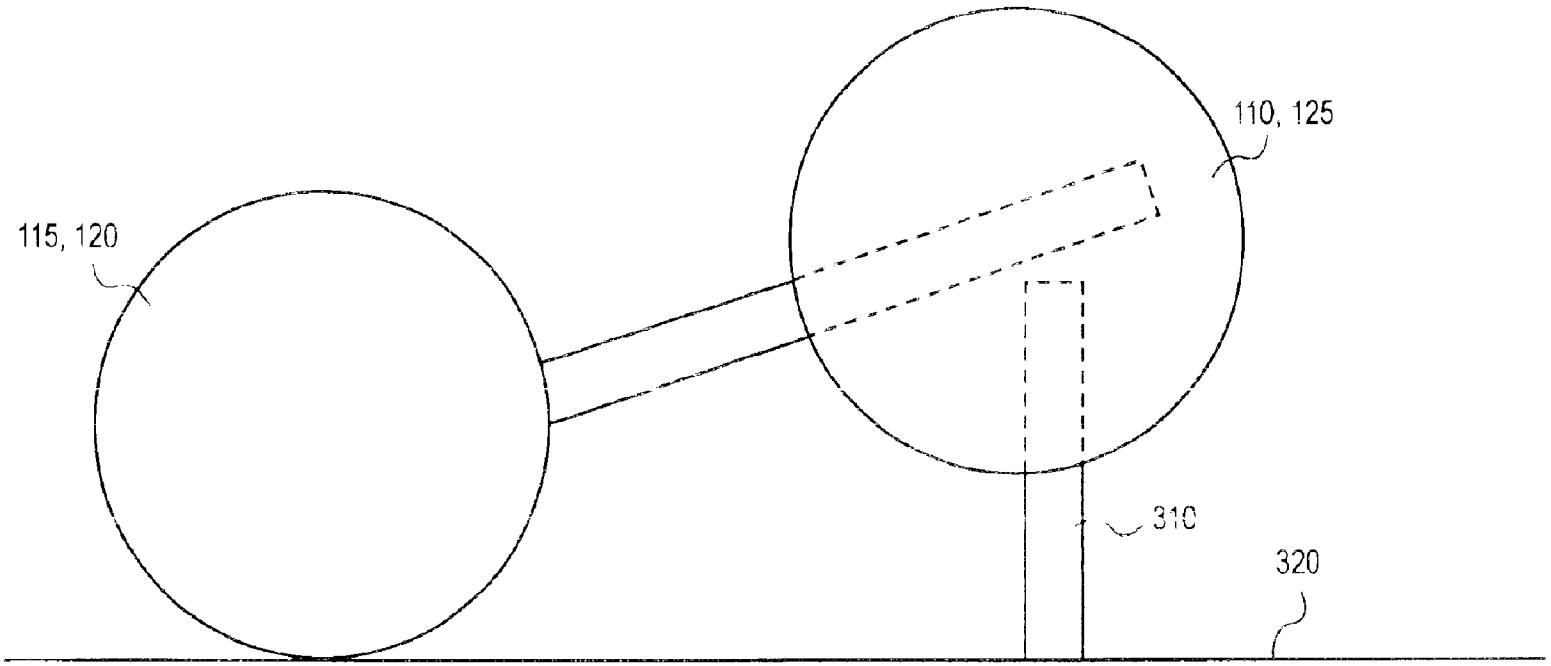
FIG. 3 is a perspective view from one side of the head rest according to one embodiment of the present invention.

FIG. 3 illustrates a perspective side view of the head rest device according to one embodiment of the present invention. The spherical components 125 and 110 comprise an adjustable leg 310 threadably coupled to each spherical component as described with reference to FIG. 5. In one embodiment the spherical components 125 and 110 are elevated from the supporting surface 320 by legs 310. The height of the elevation may be adjusted by screwing in or out the legs 310 out of the spherical components 125 and 110. In one embodiment the supporting surface 320 may be a floor on which a person may lie with his/her head resting on the head rest device. In one embodiment the legs 310 may be rigidly coupled to the spherical components 110 and 125.

In yet another embodiment the legs 310 may comprise several components and the height of the elevation may be adjusted as described with reference to FIGS. 4A and 4B. It will be appreciated that the present invention is not limited to a particular placement of the legs, and the legs may be coupled to the bottom surface of the spherical components, or to the side surface of the spherical components.

In one embodiment of the present invention, each of the spherical components 115 and 120 may also comprise an adjustable leg (not shown). The spherical components 110 and 125 may be elevated higher from the supporting surface 320 than the spherical components 115 and 120.

It will be noted by one skilled in the art that in order to ensure a secure threadable coupling of the connecting member to the spherical components, it is preferable for the spherical components to be solid. However, the connecting member may be threadably coupled to hollow spherical components via an insertion of a rod into a spherical component, the inserted rod being of a diameter corresponding to the diameter of the connecting member and the inner surface of the inserted rod being threaded to provide an ability of the connecting member to be screwed into the hollow spherical components.

In addition, the present invention is not limited to the spherical components being of identical size, or of any particular diameter. Spherical components 115 and 120 do not have to be of the same size as spherical components 110 and 125. For example, the spherical components 115 and 120 may be spheres of the identical diameter and the spherical components 110 and 125 may be spheres of a diameter different than the diameter of the spherical components 115 and 120.

It will be appreciated that the above-described head rest device is not limited to four spherical components and may comprise a plurality of spherical components to provide contact with a plurality of acupressure points on the back of a human head. The plurality of spherical components may be coupled to each other via a combination of connecting member described above.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A head rest device comprising:

four spherical components arranged for supporting a human head, the spherical components coupled via a plurality of adjustable connecting members, at least one end of each of the plurality of connecting members being coupled to a spherical component of the four spherical components, wherein a number of the plurality of spherical components comprise adjustable legs.

2. The head rest device of claim 1 wherein the at least one end of each of the plurality of connecting members is threadably coupled to the spherical component.

3. The head rest device of claim 1 wherein the at least one end of each of the plurality of connecting members is rigidly coupled to the spherical component.

4. The head rest device of claim 3 wherein connecting members comprise a first component and a second component.

5. The head rest device of claim 4 wherein the second component has a smaller diameter than the first component.

6. The head rest device of claim 5 wherein the first component comprises an opening.

7. The head rest device of claim 6 wherein the connecting members comprise a pin to secure the first component and the second component in a user-selectable position utilizing the opening.

8. The head rest device of claim 5 wherein the second component comprises a plurality of openings.

9. The head rest device of claim 8 wherein the connecting members comprise a pin to secure a first component and a second component in a user-selectable position utilizing the plurality of openings and a pair of openings located on the first component.

10. The head rest device of claim 4 wherein the connecting members comprise a screw to secure the first component and the second component in a user-selectable position.

11. The head rest device of claim 4 wherein the first component and the second component are pivotally coupled to each other.

12. The head rest device of claim 11 wherein the first component and the second component are pivotally coupled to each other via a pin.

13. The head rest device of claim 11 wherein the first component and the second component are pivotally coupled to each other via a screw.

14. The head rest device of claim 1 wherein the adjustable legs are threadably coupled to the spherical components.

15. The head rest device of claim 1 wherein the adjustable legs comprise a first component and a second component, the second component having a smaller diameter than the first component, the first component comprising an opening, and a pin to secure the first component and the second component in a user-selectable position utilizing the opening.

16. A head rest device comprising:

a first spherical component connected to a second spherical component via a first connecting member, the first connecting member comprising a first end and a second end, the first end coupled to the first spherical component and the second end coupled to the second spherical component;

a third spherical component connected to a fourth spherical component via a second connecting member, the second connecting member comprising a first end and a second end, the first end coupled to the fourth spherical component and the second end coupled to the third spherical component;

the second spherical component connected to the third spherical component via third connecting member, the third connecting member comprising a first component and a second component coupled to each other at one end, an opposite end of the first component is coupled to the second spherical component and an opposite end of the second component is coupled to the third spherical component;

the first spherical component comprising a first adjustable leg and the fourth spherical component comprising a second adjustable leg, the first adjustable leg and the second adjustable leg to provide elevation from a supporting surface.

17. The head rest device of claim 16 wherein the first end of the first connecting member is threadably coupled to the first spherical components and the second end of the first connecting member rigidly coupled to the second spherical component.

18. The head rest device of claim 16 wherein the first end of the second connecting member is threadably coupled to the fourth spherical component and the second end of the second connecting member is rigidly coupled to the third spherical component.

19. The head rest device of claim 16 wherein the first component of the third connecting member and the second component of the third connecting member are pivotally coupled to each other at the one end, the opposite end of the first component is threadably coupled to the second spherical component and the opposite end of the second component is threadably coupled to the third spherical component.

20. The head rest device of claim 19 wherein the first component comprises an opening at the one end and the second component comprises an opening at the other end.

21. The head rest device of claim 19 wherein the first component and the second component are pivotally coupled to each other at the one end via a pin.

22. The head rest device of claim 16 wherein the first adjustable leg is threadably coupled to the first spherical component.

23. The head rest device of claim 16 wherein the second adjustable leg is threadably coupled to the fourth spherical component.

24. A head rest device comprising:

a plurality of means for coupling four spherical means arranged for supporting a human head, at least one end of each of the plurality of means for coupling being coupled to a spherical means from the plurality of the four spherical means wherein the at least one end of each of the plurality of the means for coupling is threadably coupled to the spherical means, wherein a number of the four spherical means comprise adjustable legs.

25. The head rest device of claim 24 wherein means for coupling comprise first means and second means.

26. The head rest device of claim 25 wherein the first means and the second means are pivotally coupled to each other.

* * * * *